United States Patent [19]

Staas et al.

[11] 4,136,531

[45] Jan. 30, 1979

[54] $^3$HE-$^4$HE DILUTION REFRIGERATOR

[75] Inventors: Frans A. Staas; Adrianus P. Severijns, both of Eindhoven, Netherlands

[73] Assignee: U.S. Philips Corporation, New York, N.Y.

[21] Appl. No.: 795,879

[22] Filed: May 11, 1977

[30] Foreign Application Priority Data

May 26, 1976 [NL] Netherlands ..... 7605645

[51] Int. Cl.$^2$ ..... F25B 1/00

[52] U.S. Cl. ..... 62/502; 62/514 R

[58] Field of Search ..... 62/502, 514 R, 113

[56] References Cited

U.S. PATENT DOCUMENTS

| | | | |
|---|---|---|---|
| 3,835,662 | 9/1974 | Staas et al. | 62/514 R |
| 3,922,881 | 12/1975 | Staas et al. | 62/514 R |

*Primary Examiner*—Ronald C. Capossela

*Attorney, Agent, or Firm*—Frank R. Trifari; Rolf E. Schneider

[57] ABSTRACT

A $^3$He-$^4$He dilution refrigerator is provided with two interconnected mixing chambers arranged at different levels. One end of a superleak opens into concentrated $^3$He contained in the upper mixing chamber, while the other end opens into a portion of the apparatus containing dilute $^3$He for the supply of superfluid $^4$He, via the superleak, to the upper mixing chamber under the influence of the osmotic differential pressure prevailing across the superleak.

7 Claims, 4 Drawing Figures

$^3$HE-$^4$HE DILUTION REFRIGERATOR

Figure 1:
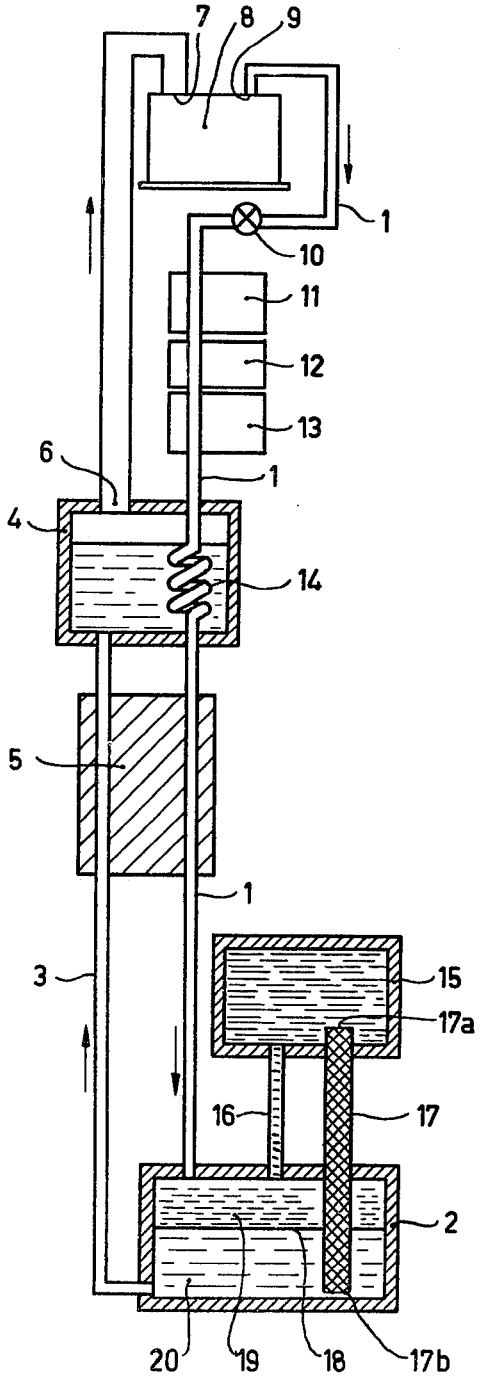

This invention relates to a $^3$He-$^4$He dilution refrigerator for extremely low temperatures, comprising a first mixing chamber for $^3$He and $^4$He, provided with a supply duct for the supply of liquid concentrated $^3$He, the said first mixing chamber being connected, by way of a first communication duct for dilute $^3$He which is in heat-exchanging contact with the supply duct, to a vaporization chamber for separating dilute $^3$He into $^3$He and $^4$He, the said vaporization chamber having an outlet for helium consisting substantially of $^3$He gas, the first mixing chamber furthermore communicating with a second mixing chamber, arranged at a higher level, via a second communication duct, one end of which opens into the second mixing chamber at the bottom, whilst the other end opens into the first mixing chamber at the top, there being provided at least one superleak, one end of which opens into the second mixing chamber for the supply of superfluid $^4$He thereto.

A refrigerator of the described kind is known from the article "Continuous cooling in the millikelvin range," published in Philips Technical Review 36, 1976, No. 4, pages 104–114 (FIG. 13).

The superleak therein forms part of a fountain pump which furthermore includes a second superleak, a heating element and a capillary. Superfluid $^4$He is extracted from the vaporization chamber and is supplied to the second mixing chamber by the fountain pump. The superfluid $^4$He reaches the vaporization chamber again via the first mixing chamber. As a result of the $^4$He circulation in addition to the $^3$He circulation normally occurring in the dilution refrigerator, a cooling capacity is obtained which is substantially larger than if use is made of $^3$He circulation only.

In dilution refrigerators with $^3$He circulation only, for given experiments temperatures are temporarily produced which are lower than the cooling temperatures occurring during normal, continuous operation; this is realized by stopping the supply of concentrated $^3$He to the mixing chamber in which the cold production takes place (single-shot experiments). Stopping can be simply effected by setting a valve in the $^3$He gas supply of the apparatus which is at room temperature to the closed position.

Due to the interruption of the flow of concentrated $^3$He to the mixing chamber, the transport of heat to the mixing chamber is reduced and the temperature therein decreases.

Whilst the pumping of $^3$He gas from the vaporization chamber continues after the interruption of the flow of concentrated $^3$He, the level of the interface present in the mixing chamber between the dilute $^3$He and the concentrated $^3$He of lower specific gravity which floats thereon continuously becomes higher, because the concentrated $^3$He in the mixing chamber gradually dissolves in the dilute $^3$He which takes the place of the dissolved concentrated $^3$He as a result of the hydrostatic pressure of the dilute $^3$He in the communication duct between the mixing chamber and the vaporization chamber. As long as concentrated $^3$He is present in the mixing chamber, the lower cooling temperature can be maintained.

A dilution refrigerator comprising two mixing chambers which are arranged at different levels and which are interconnected via a narrow duct offers the advantage for single-shot experiments that an apparatus of this kind can temporarily produce cooling temperatures which are even lower than those produced by an apparatus comprising only a single mixing chamber. This is because when the interface between the concentrated $^3$He and dilute the $^3$He has moved from the lower mixing chamber to the upper mixing chamber, so that cold production takes place in the latter chamber, the cold production in the upper mixing chamber is substantially more effective than in the apparatus comprising a single mixing chamber; this is due to the low heat conduction from the lower mixing chamber to the upper mixing chamber (the use of a narrow duct having a diameter of only a few millimeters). As a result, a single-shot experiment can be performed at a lower temperature and usually for a longer period of time in an apparatus comprising two mixing chambers than in an apparatus comprising one mixing chamber.

The cooling of the upper mixing chamber, however, is a problem in the apparatus comprising two mixing chambers. Because, when the apparatus is started, the interface between the concentrated $^3$He and dilute the $^3$He is situated in the lower mixing chamber and the cold production, therefore, initially takes place therein, the upper mixing chamber assumes the low temperature of the lower mixing chamber only after a very long period of time (order of magnitude: $\frac{1}{2}$ to 1 day) due to the said low heat conduction. A single-shot experiment can be started only after such a long waiting period, if it is to be prevented that part of the cold production available for the single-shot experiment is used for the cooling of the upper mixing chamber. The latter means a substantial reduction of the time during which the lowest cooling temperature for the single-shot experiment in the upper mixing chamber can be maintained.

Moreover, in the case of a comparatively high heat load from the object to be cooled, there is a risk that the desired low value of the cooling temperature is not reached.

The present invention has for its object to provide a $^3$He-$^4$He dilution refrigerator of the described kind which combines for single-shot experiments, in a structurally simple manner, a short cooling time of the second mixing chamber, arranged at a level higher than that of the first mixing chamber, with a very low cooling temperature of this second mixing chamber which can be maintained for a very long period of time.

In accordance with the invention, the $^3$He-$^4$He dilution refrigerator of the described kind is characterized in that the other end of the superleak opens directly into and near the bottom of the vaporization chamber or the first mixing chamber, or opens directly into the first communication duct for taking up superfluid $^4$He from dilute $^3$He at the relevant area.

It is thus achieved that, due to an osmotic pressure difference across the superleak, possibly supported by gravitation, superfluid $^4$He originating from the dilute $^3$He in the first mixing chamber, the first communication duct or the vaporization chamber, flows through the superleak to the second mixing chamber of higher temperature which contains concentrated, substantially pure $^3$He. The superfluid $^4$He then flows from lower to higher osmotic pressure.

The superfluid $^4$He entering the second mixing chamber dilutes the concentrated $^3$He, which is accompanied by development of cold and hence cooling of the second mixing chamber. The dilute $^3$He formed in the second mixing chamber falls, due to its higher specific density, through the concentrated $^3$He, via the second communication duct, into the first mixing chamber where it mixes with the dilute $^3He$ present therein.

Because the flow of dilute $^3He$ which leaves the second mixing chamber via the second communication duct is separated from the flow of superfluid $^4He$ supplied to this chamber via the superleak, there is no mutual friction which might be accompanied by development of heat.

Because the temperature of the second mixing chamber is thus very quickly brought to the same or even a lower temperature than that of the first mixing chamber, a single-shot experiment may commence after a very brief period of time.

The complete supply of concentrated $^3He$ in the upper mixing chamber and in the upper part of the lower mixing chamber can then be used for maintaining a very low cooling temperature for a prolonged period of time. Because the heat conduction of a superleak is poor, substantially no heat will flow to the second mixing chamber via this superleak.

A preferred embodiment of the $^3He$-$^4He$ dilution refrigerator in accordance with the invention is characterized in that when the superleak opens into the vaporization chamber or the first communication duct, this first communication duct or the part of this duct which is situated upstream from the such opening is constructed so that the $^3He$ therein exceeds its critical velocity at least locally.

It has been found, that, due to the fact that the $^3He$ has a velocity greater than its critical velocity, this $^3He$ draws along superfluid $^4He$, so that dilute $^3He$ present at the area of the opening of the superleak into the vaporization chamber or the first communication duct is diluted further, with the result that the local osmotic pressure decreases. The osmotic differential pressure across the superleak thus increases. This causes an increase of the flow of superfluid $^4He$ through the superleak to the second mixing chamber (the superfluid $^4He$ flows from lower to higher osmotic pressure). As a result of the additional supply of superfluid $^4He$, the second mixing chamber is not only cooled faster but also assumes a still cooling temperature, which lower temperature can be maintained also during the single-shot experiment.

A further preferred embodiment of the $^3He$-$^4He$ dilution refrigerator in accordance with the invention is characterized in that when the superleak opens into the first mixing chamber the superleak is arranged within the second communication duct.

As a result of this arrangement, the leakage of heat from the first mixing chamber to the second mixing chamber arranged thereabove is reduced.

The invention will now be described in detail with reference to the accompanying drawings which diagrammatically show some preferred embodiments of the present $^3He$-$^4He$ dilution refrigerator and in which:

FIG. 1 is a longitudinal sectional view of a dilution refrigerator with two mixing chambers and a superleak in which the end of the superleak which is remote from the upper of the two mixing chambers opens into and near the bottom of the other, lower mixing chamber.

Figure 1A:
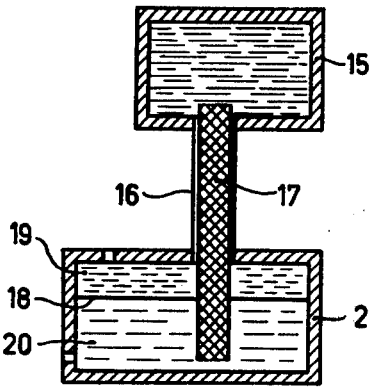

FIG. 1*a* is a longitudinal sectional view of the two mixing chambers shown in FIG. 1 which are interconnected via a duct, the superleak being arranged within the said duct.

Figure 2:
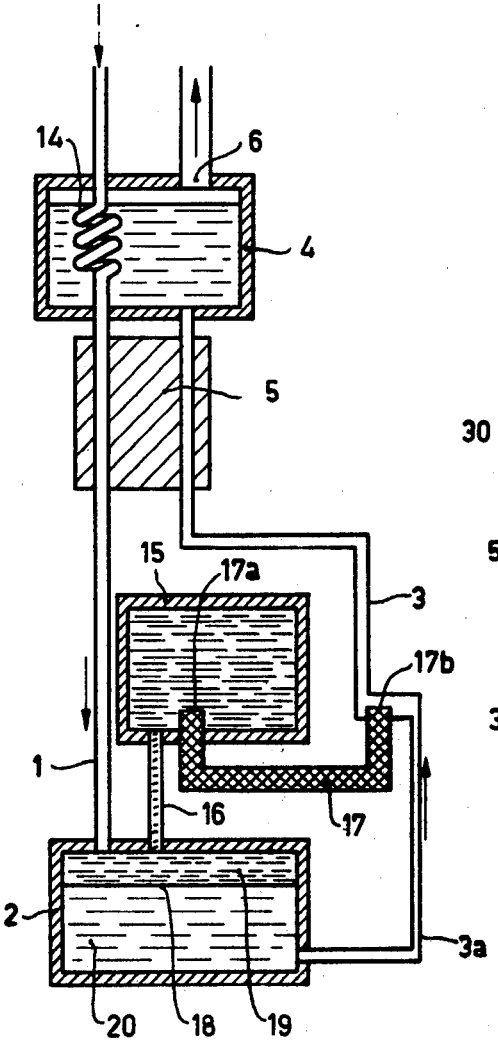

FIG. 2 is a partial longitudinal sectional view of a dilution refrigerator in which the end of the superleak which is remote from the upper mixing chamber opens into the communication duct between the lower mixing chamber and the vaporization chamber, the part of this communication duct which is situated between the lower mixing chamber and the area of such superleak connection thereto being constructed as a capillary.

Figure 3:
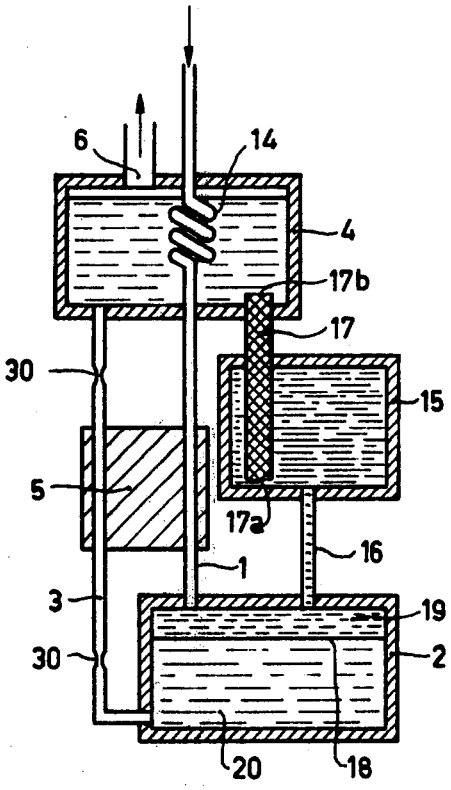

FIG. 3 is a partial longitudinal sectional view of a dilution refrigerator in which the upper mixing chamber communicates with the vaporization chamber via the superleak, constrictions being provided in the communication duct between the lower mixing chamber and the vaporization chamber.

The reference numeral 1 in FIG. 1 denotes a supply duct for concentrated $^3He$ which opens into a mixing chamber 2 which is connected, via a communication duct 3 for dilute $^3He$, to a vaporization chamber 4. A heat exchanger 5 is included on the one side in the supply duct 1 and in the communication duct 3 on the other side.

The vaporization chamber 4 includes an outlet 6 for substantially $^3He$ gas which is connected to the inlet 7 of a pump system 8, the outlet 9 of which is connected to the supply duct 1. The supply duct 1 includes a valve 10, precooling devices 11, 12 and 13, and a heat exchanger 14 which is arranged inside the vaporization chamber 4. The precooling device 11 is formed, for example, by a liquid nitrogen bath (78 K), whilst the precooling devices 12 and 13 consist, for example, of liquid helium baths of 4.2 K and 1.3 K, respectively.

Above the mixing chamber 2 there is arranged a second mixing chamber 15, the lower side of which is connected, via a communication duct 16, to the upper side of the mixing chamber 2. The communication duct 16 is constructed as a narrow pipe having a diameter of a few millimeters in order to ensure that the heat conduction of the connection between the two mixing chambers is poor.

One end **17*a* of a superleak 17 which, as is known, does not or does not substantially let pass normal $^4He$ but which lets pass superfluid $^4He$, opens into and near the bottom of the upper mixing chamber 15, whilst its other end 17*b* opens into and near the bottom of the lower mixing chamber 2. The heat conduction of the superleak 17 is poor for the same reason as that of the duct 16**.

The valve 10 is initially in the open position during operation.

The pump system 8 then supplies substantially pure $^3He$ gas to the supply duct 1. In the precooling devices 11, 12, 13 and the heat exchanger 14, the $^3He$ gas condenses and its temperature is lowered to approximately 0.7 K. In the heat exchanger 5, the liquid concentrated $^3He$ is subjected to a further temperature decrease and subsequently enters the mixing chamber 2 in which there are two phases 19 and 20 of concentrated $^3He$ and dilute $^3He$ ($^3He$ dissolved in $^4He$) which are separated by an interface 18. In the dilute $^3He$, the $^4He$ is superfluid. A transition of $^3He$ from the phase 19, via the interface 18, to the phase 20 causes cooling. The $^3He$ which has passed the interface 18 flows in the dilute phase, via the communication duct 3, to the vaporization chamber 4, and on its way cools concentrated $^3He$ in the heat exchanger 5 which is on its way to the mixing chamber 2.

The vaporization chamber 4 is drained by the pump system 8. Because the vapour pressure of the $^3He$ is much higher than that of the $^4He$, substantially pure $^3He$ leaves the vaporization chamber 4 via the outlet 6. After compression, the sucked $^3He$ is supplied to the supply duct 1 again by the pump system 8.

In the situation shown, concentrated $^3He$ is present not only in the upper part of the lower mixing chamber 2, but also in the communication duct 16 and the upper mixing chamber 15.

If the superleak 17 were not present, the temperature in the mixing chamber 15 would assume the same low temperature as that of the mixing chamber 2 only after a very long period of time, because the production of cold takes place in the mixing chamber 2 and because the heat conduction of the connection between the mixing chamber 15 and the mixing chamber 2 is poor. Thanks to the superleak 17, the lower end **17*b* of which projects into dilute $^3He$ whilst its upper end 17*a* is present in concentrated $^3He$, superfluid $^4He$ can flow from the dilute $^3He$ in the mixing chamber 2, via this superleak, to the concentrated $^3He$ in the mixing chamber 15. The driving force in this respect is formed by the difference in the osmotic pressures of $^3He$ on both sides of the superleak 17. The osmotic pressure of the $^3He$ in the dilute solution at the area of the superleak 17*b* is lower than that in the concentrated solution at the area of the superleak end 17*a*. Consequently, superfluid $^4He$ flows in the direction from lower to higher osmotic pressure, i.e. from the mixing chamber 2 to the mixing chamber 15**.

The superfluid $^4He$ which leaves the superleak at the area **17*a* dilutes the concentrated $^3He$ present at this area, which is accompanied by cold production in the same manner as at the interface 18. As a result, the mixing chamber 15 assumes the low temperature of the mixing chamber 2 within a very short period of time. The dilute $^3He$ formed in the mixing chamber 15, having a higher specific gravity than the concentrated $^3He$ at this area, falls through the communication duct 16 and mixes with the dilute $^3He$ phase 20 in the mixing chamber 2**.

Because the mixing chamber 15 is cooled very quickly, soon a single-shot experiment can be started, an object (not shown) which is in thermal contact with the mixing chamber 15 then being cooled to a very low temperature (a few mK). To this end, the valve 10 is closed, so that the supply of concentrated $^3He$ to the mixing chamber 2 terminates, except for some residual supply from the heat exchangers 5 and 14 and the supply duct 1. The stopping of the flow of concentrated $^3He$ means that there is one less heat transporter to the mixing chamber 2. Consequently, the temperature in the mixing chamber 2 decreases and, due to transport of superfluid $^4He$ via the superleak 17, also in the mixing chamber 15.

As the pump system 8, is continuously pumping and $^3He$ is sucked off, the cooling process in the mixing chamber 2 continues. The supply of concentrated $^3He$ present in the mixing chamber 15, the communication duct 16 and at the top of the mixing chamber 2 gradually changes over to the dilute $^3He$ phase 20. Under the influence of the hydrostatic pressure of the dilute $^3He$ present in the communication duct 3, dilute $^3He$ takes the place of the disappearing concentrated $^3He$. Consequently, the interface 18 gradually moves upwards to the mixing chamber 15. Once it has arrived in the mixing chamber 15, the cold production takes place in this chamber and, because of the poor heat conduction from the mixing chamber 2 to the mixing chamber 15, a temperature is reached in the latter chamber which is substantially lower than that in the chamber 2.

Thus, not only the temperature of the object to be cooled can be lowered to a very low value, but this temperature can also be maintained for a long period of time. This is because the mixing chamber 15 is efficiently thermally insulated.

As a result of the arrangement (FIG. **1*a*) of the superleak 17 within the communication duct 16**, which has a diameter so that a capillary annular duct is formed between the two elements, the heat leakage from the lower mixing chamber to the upper mixing chamber is reduced.

The dilution refrigerator shown in FIG. 2 is substantially similar to that shown in FIG. 1. The upper section of the apparatus is not shown in this Figure. The same reference numerals are used for parts corresponding to those of FIG. 1. The differences are as follows. The end **17*b* of the superleak 17 now opens into the communication duct 3 between the mixing chamber 2 and the vaporization chamber 4. Furthermore, the portion 3*a* of the communication duct 3 which is situated between the mixing chamber 2 and the superleak end 17*b* is constructed as a capillary in which the $^3He$ has a velocity higher than its critical velocity. The major advantage thereof consists in that superfluid $^4He$ is thus drawn along with the $^3He$. Due to the increasing concentration of superfluid $^4He$ at the area of the superleak end 17*b* (or due to a further dilution of the $^3He$ at this area), the osmotic pressure at this area decreases. The osmotic differential pressure across the superleak 17 thus increases, which causes a larger flow of superfluid $^4He$ from the communication duct 3 to the mixing chamber 15. As a result, not only the temperature of the mixing chamber 15** decreases faster, but also a lower temperature is reached than if no drawing effect were present.

The drawing effect is maintained during the single-shot experiment, because $^3He$ is sucked off from the vaporization of chamber 4. Because the $^4He$ need not flow against the dilute $^3He$, this also implies an extra low cooling temperature of the mixing chamber 15 during such an experiment (no mutual friction). The operation is further as described with reference to FIG. 1.

The dilution refrigerator shown in FIG. 3 differs from that shown in FIG. 2 in that the superleak end **17*b* opens into the vaporization chamber 4, near the bottom of this chamber, so that it can always take up superfluid $^4He$ from the dilute phase present. The communication duct 3 is provided with constrictions 30 which ensure that the $^3He$, as a result of the exceeding of its critical velocity, draws along $^4He$ to the vaporization chamber 4, so that the osmotic pressure in this chamber decreases and a larger flow of superfluid $^4He$ passes through the superleak 17 to the mixing chamber 15**.

In addition to the osmotic pressure effect and the drawing effect, there is in the present case also a gravitational effect which stimulates the flow of superfluid $^4He$ from the vaporization chamber 4 through the superleak 17 to the mixing chamber 15.

The apparatus further operates as described with reference to FIG. 1.

By means of such an apparatus, with a volume of the mixing chamber 15 of approximately 10 $cm^3$ and a pump rate of the pump system 8 of $1.10^{-5}$ mol $^3He$/sec., it is possible to perform a single-shot experiment where an object is maintained at a constant low temperature of 3 mK for a period of approximately 10 hours.

What is claimed is:

1. A $^3He$-$^4He$ dilution refrigerator for producing extremely low temperatures, which comprises pump means for circulating and compressing gaseous $^3He$, means for cooling and condensing the compressed $^3He$, a heat exchanger for further cooling the condensed $^3He$, a first mixing chamber for receiving the cooled condensed $^3He$ for separation into liquid concentrated $^3He$ and liquid dilute $^3He$ containing superfluid $^4He$, a supply duct for flowing the compressed $^3He$ from said pump means through said cooling and condensing means and said heat exchanger to said first mixing chamber, a vaporization chamber for receiving liquid dilute $^3He$ from said first mixing chamber for separation of gaseous $^3He$, a return duct for flowing liquid dilute $^3He$ from said first mixing chamber through said heat exchanger in heat-exchange relation with said supply duct to said vaporization chamber, a suction duct for flowing the gaseous $^3He$ from said vaporization chamber to said pump means, a second mixing chamber arranged at a level higher than said first mixing chamber, a communication duct having one end opening into the bottom of said second mixing chamber and its other end opening into the top of said first mixing chamber, and a superleak having one end opening into the second mixing chamber for the supply of superfluid $^4He$ thereto, the other end of said superleak opening directly into a space containing dilute $^3He$ for taking up superfluid $^4He$ from said dilute $^3He$.

2. A $^3He$-$^4He$ dilution refrigerator according to claim 1, in which the other end of said superleak opens directly into and near the bottom of said first mixing chamber.

3. A $^3He$-$^4He$ dilution refrigerator according to claim 2, in which said superleak is positioned within the communication duct.

4. A $^3He$-$^4He$ dilution refrigerator according to claim 1, in which the other end of said superleak opens directly into the return duct.

5. A $^3He$-$^4He$ dilution refrigerator according to claim 4, in which at least a portion of the return duct between the first mixing chamber and the opening of the superleak into said return duct has a cross section less than that of the balance of the return duct.

6. A $^3He$-$^4He$ dilution refrigerator according to claim 1, in which the other end of said superleak opens directly into and near the bottom of said vaporization chamber.

7. A $^3He$-$^4He$ dilution refrigerator according to claim 6, in which the return duct has one or more constrictions between the first mixing chamber and said vaporization chamber.

* * * * *